United States Patent [19]

Hurst

[11] 3,964,234

[45] June 22, 1976

[54] CAPPING MACHINE

[75] Inventor: Richard F. Hurst, Malvern, Pa.

[73] Assignee: Sidney Rosen, Baltimore, Md.

[22] Filed: Jan. 7, 1975

[21] Appl. No.: 539,044

[52] U.S. Cl. ..... 53/77; 53/334

[51] Int. Cl.[2] ..... B67B 3/18; B65B 7/28; B65B 57/00

[58] Field of Search ..... 53/334, 331, 329, 335, 53/336, 337, 42, 77, 351, 306, 308

[56] References Cited

UNITED STATES PATENTS

| | | | |
|---|---|---|---|
| 1,290,706 | 1/1919 | Brenzinger | 53/334 X |
| 2,372,138 | 3/1945 | Underwood | 53/331 |
| 3,055,155 | 9/1962 | Fox | 53/331 X |
| 3,076,300 | 2/1963 | Luedi et al. | 53/331 |
| 3,125,020 | 3/1964 | Surina | 53/77 X |
| 3,713,268 | 1/1973 | Gess | 53/334 |
| 3,775,944 | 12/1973 | Roberts | 53/334 |

*Primary Examiner*—Travis S. McGehee
*Assistant Examiner*—Horace M. Culver
*Attorney, Agent, or Firm*—Craig & Antonelli

[57] ABSTRACT

An electric capping machine for crimping the caps of containers, in which each cycle of operation takes place fully automatically, once initiated by the operator; in the course of each operation, a container-receiving member is automatically raised into engagement with a spring-loaded abutment roller of the crimping mechanism which, upon further upward movement, causes the crimping roller to be positively brought into engagement with the edge of the cap by the use of a quadrilateral linkage connection actuated by a cam follower; to increase the safety to the operating personnel, both hands must be placed in a predetermined position relative to the machine before the cycle of operation can be initiated.

38 Claims, 7 Drawing Figures

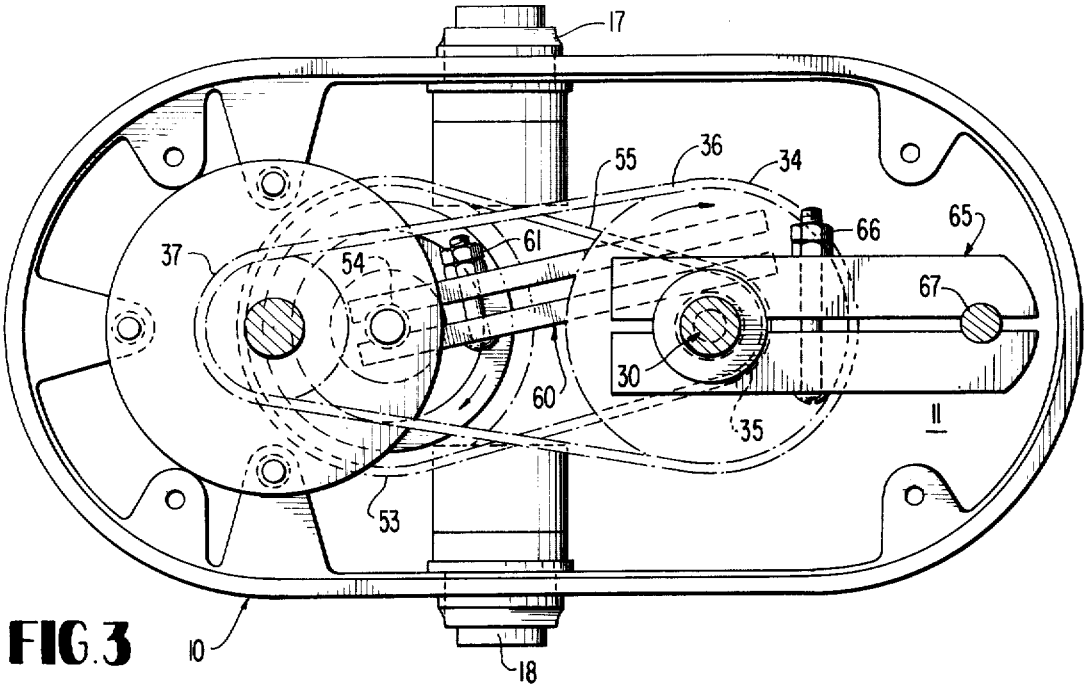
FIG. 3
FIG. 5
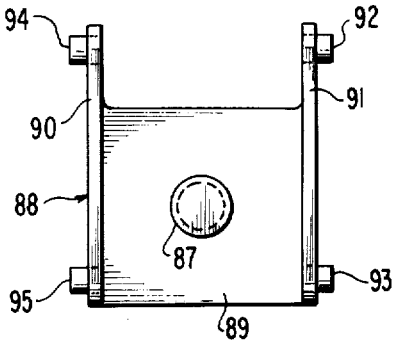
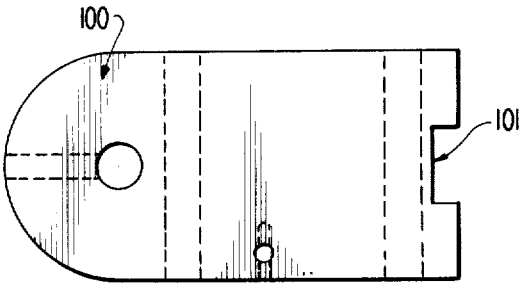
FIG. 4
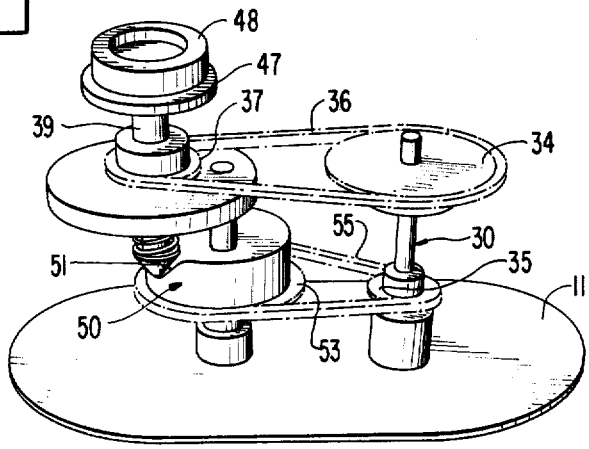
FIG. 6

CAPPING MACHINE

The present invention relates to an electric capping machine, and more particularly to a semi-automatic electric capping machine for crimping the caps of containers, bottles, vials and the like.

Various types of capping machines are known in the art which cap containers, bottles, or the like by crimping the edges of the caps. These prior art capping machines range from fully manual to the fully automatic machines of varying complexity. However, fully automatic machines, as exemplified, for instance, by the U.S. Pat. No. 3,151,426 to Pechmann involve a relatively high initial investment and therefore are not suitable in those cases where the machine is not used for continuous, large-scale series production of identical containers but is intended primarily for containers, bottles, etc. involving different types and sizes of bottles and containers which are to be capped in relatively small series production. Another type of capping machine is illustrated in U.S. Pat. No. 3,055,155, to Fox in which all parts of the machine are driven from a central electric motor so that counter-weighted levers move under the action of centrifugal forces to effect the capping operation. Apart from being relatively complex in mechanical construction, reliance on centrifugal forces entails certain disadvantages as regards reliability of operation.

A positive action capping mechanism is known as such in the art, as exemplified by the U.S. Pat. No. 1,452,410 to Boucher and the Canadian Patent No. 545,417 to Ford et al. However, both of these patents do not provide a semi-automatic operation in which the bottle or container is automatically raised and lowered in the course of the cycle of operation, not to mention the fact that these capping mechanisms are relatively complicated from a mechanical point of view.

The present invention is therefore concerned with the task to provide an electric capping machine which avoids the aforementioned shortcomings and drawbacks and which provides a fully automatic operation of elevating and crimping the cap on the container together with special safety features so as to increase the speed of production without loss in safety, even in case the total number of containers to be capped of a given type and size is relatively small. The present invention, therefore, essentially consists in an electric capping machine in which the container or bottle to be capped is automatically raised while being rotated so that the cap which had previously been placed on the bottle will automatically be crimped by a positive crimping action of a crimping roller, once in the fully raised position. The underlying problems are solved according to the present invention by providing an electric driving motor which, by way of two chain and sprocket drives, drives a platform shaft at a relatively higher speed and a central cam shaft at a relatively lower speed whereby rotation of a cam driven by the central cam shaft causes the platform shaft and the platform as well as the container-receiving member mounted thereon to be automatically raised so that the cap on the container will engage a spring-loaded abutment roller which, when being raised against spring action, will cause the crimping roller to move automatically toward the edge of the cap to perform the crimping operation while the cap together with the container continues to rotate. The actuation of the crimping roller into its operable position is realized by the follower action of a roller which forms part of a quadrilateral linkage system and which engages with a tapering camming surface on a relatively fixed housing member.

The electric capping machine of the present invention is not only relatively simple in construction and therefore can be manufactured at relatively low costs, but additionally, is both reliable and quiet in operation while at the same time assuring ease of operation for the operator due to the particular construction of the housing which provides access to the crimping mechanism on practically three sides thereof. Furthermore, though the operation is fully automatic, once an operating cycle is initiated, the capping machine of the present invention ensures high operating safety as each operating cycle can be initiated only by simultaneously actuating two push buttons or the like, thereby eliminating the possibility of injury to the hands of the operator.

A further feature of the present invention resides in the flexibility of the capping machine of this invention being adapted to containers, vials and bottles of the most varied types and sizes without great difficulties by a simple adjustment and/or interchange of a few parts.

Still another feature of the present invention resides in a crimping action which, contrary to so-called "jaw" or "chuck" type crimpers, can be used in securing caps on containers, bottles or vials that are not perfectly round as is the case with most production glass items.

Accordingly, it is an object of the present invention to provide an electric capping machine which obviates by simple means the aforementioned shortcomings and drawbacks encountered in the prior art.

Another object of the present invention resides in an electric capping machine which offers a completely automatic operating cycle for each capping operation, thereby eliminating the need for skilled, experienced operators while at the same time increasing the speed of production.

A further object of the present invention resides in an electric capping machine which is characterized by great versatility and flexibility in its use with containers of the most different types and sizes.

Still another object of the present invention resides in a semiautomatic electric capping machine which assures greater safety to the operating personnel.

Another object of the present invention resides in an electric capping machine that involves relatively few parts of simple construction and therefore can be manufactured relatively inexpensively.

A further object of the present invention resides in an electric capping machine of the type described above which can be easily serviced and operated, yet has a long length of life due to the sturdiness of its construction and simplicity of its parts.

These and other objects, features and advantages of the present invention will become more apparent from the following description when taken in connection with the accompanying drawing which shows, for purposes of illustration only, one embodiment in accordance with the present invention, and wherein:

FIG. 3 is a plan view of the capping machine in accordance with the present invention, with the top parts thereof removed;

FIG. 4 is a cross-sectional view, taken along line IV—IV of FIG. 2, and illustrating the crimping head base in plan view;

FIG. 5 is a plan view on the crimping head holder as used in the crimping mechanism of the capping machine of the present invention;

FIG. 6 is a perspective view of the drive mechanism on the base plate, with the housing removed, and without push buttons and plier brakes for the sake of clarity.

Figure 1:
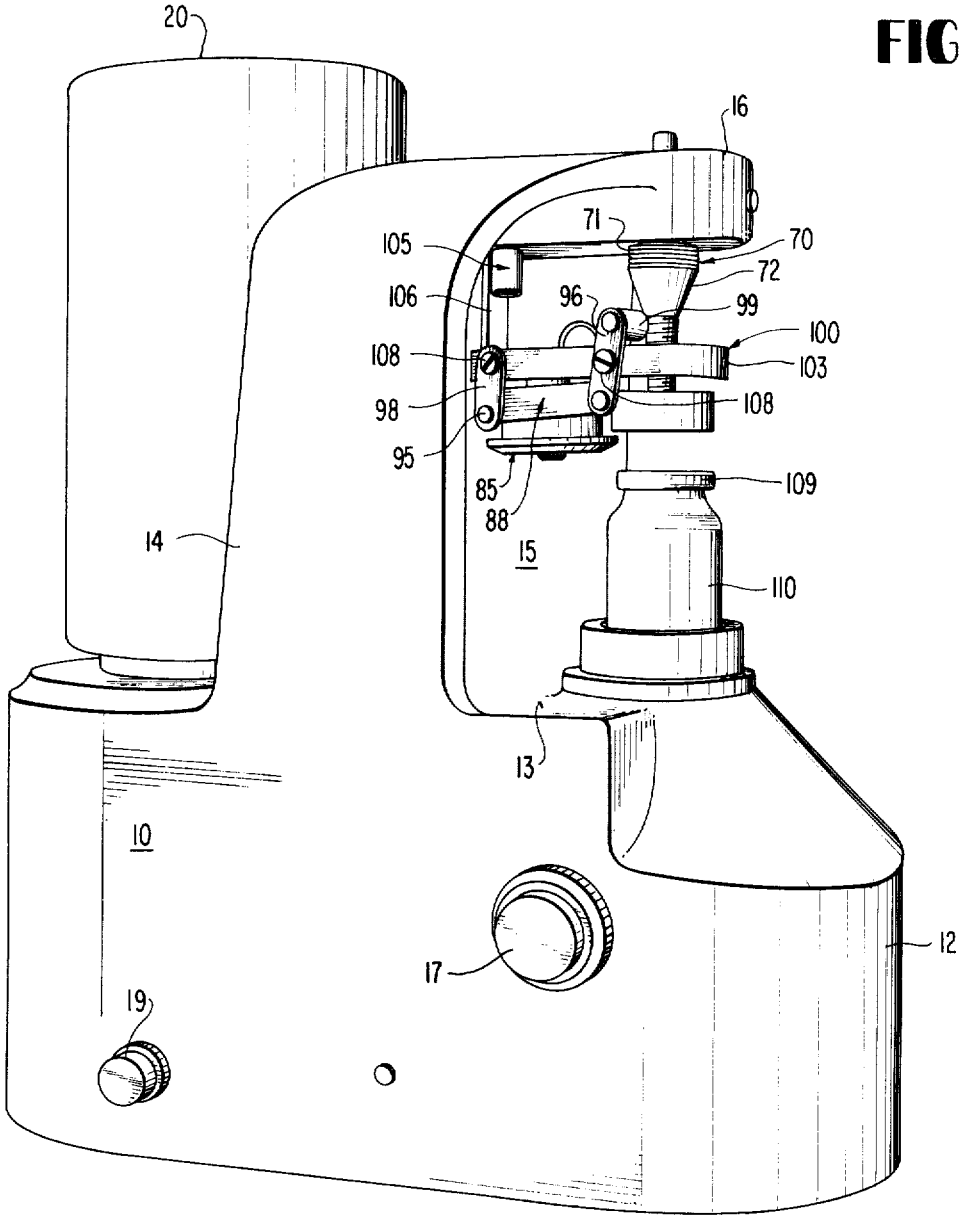
FIG. 1 is a perspective view of an electric capping machine in accordance with the present invention, as viewed from the left front thereof.
Figure 2:
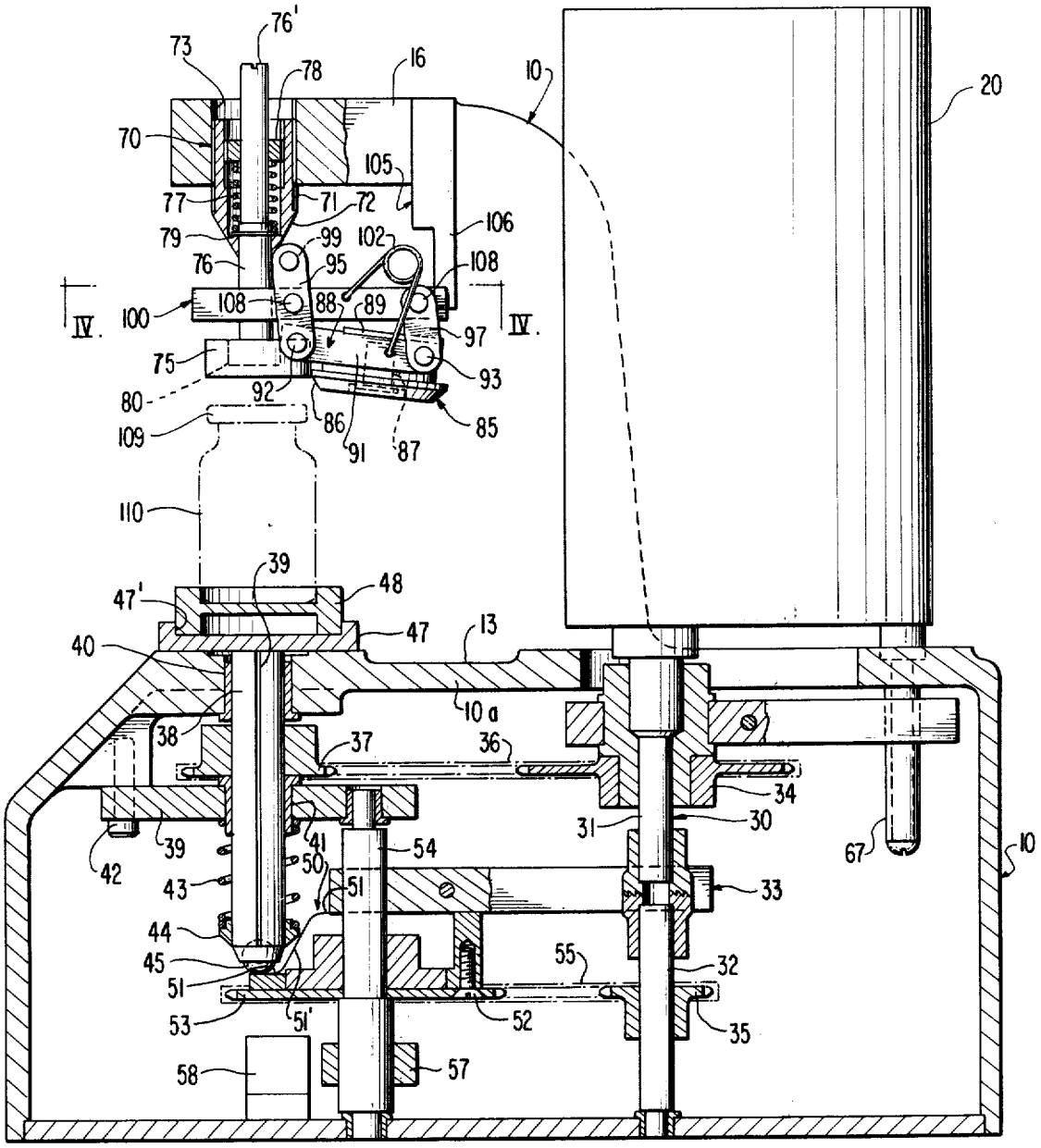
FIG. 2 is a somewhat schematic view, partly in cross section, through an electric capping machine in accordance with the present invention.

Referring now to the drawing wherein like reference numerals are used throughout the various views to designate like parts, the electric capping machine of the present invention includes a housing generally designated by reference numeral 10 (FIGS. 1, 2 and 3) which is mounted on and secured to a base plate 11 (FIGS. 2, 3 and 6). As can be best seen from FIG. 1, the housing 10 includes an approximately ship-shaped lower housing portion 12 which terminates in a substantially flat top surface 13 and is integral with two approximately L-shaped bracket housing portions 14 and 15 forming together with a reinforced, elongated top portion 16, a substantially U-shaped housing structure. As can be seen from FIG. 1, the L-shaped bracket housing portions 14 and 15 are relatively narrower over their vertically extending portions and then pass over through flared portions into the reinforced center portion 16 which is relatively longer so that the bottle raising and lifting mechanism as well as the crimping mechanism which are located nearer the front end of the machine, are readily accessible from three sides. Two push buttons 17 and 18 (FIGS. 1 and 3) are arranged on both sides of the housing 10 substantially mutually opposite one another which have to be simultaneously depressed, as will be explained more fully hereinafter, in order to start the automatic capping operation. FIG. 1 additionally illustrates a fuse holder 19 to permit ready exchange of fuses. Additionally, the single electric motor 20 which is a conventional fractional horsepower gear motor and which is shown in FIG. 1, is mounted on the top surface 13.

The electric motor 20 drives by way of a suitable drive connection of any conventional type a motor driven rear shaft generally designated by reference numeral 30 which is rotatably supported in the housing 10 and in the base plate 11 by conventional bearing. The shaft 30 may be composed of an upper shaft portion 31 and of a lower shaft portion 32 suitably connected with each other by way of a conventional one-way or over-running clutch generally designated by reference numeral 33 which permits relative rotation between the shaft portions 31 and 32 in one direction but drivingly connects the same in the opposite direction of rotation, i.e., the clockwise direction of rotation in FIG. 3, in order to provide an over-running action in said one direction, i.e., in the counterclockwise direction of rotation as viewed in FIG. 3, in which the arrows indicate the normal direction of rotation of the various parts.

A first sprocket wheel 34 is fixedly connected by conventional means with the upper shaft portion 31 while a second sprocket wheel 35 is fixedly connected with the lower shaft portion 32. The first sprocket wheel 34 drives by way of a chain 36 a third sprocket wheel 37 which is operatively connected with the platform shaft 38 by way of a splined connection 39 so as to prevent relative rotation between the sprocket wheel 37 and the platform shaft 38 while permitting an up and down movement of the platform shaft 38 relative to the sprocket wheel 37 which is fixedly held in place between the upper housing wall 10*a* and an intermediate supporting wall portion 39 by way of suitable thrust bearings 40 and 41 or the like. The intermediate supporting wall portion 39 is thereby appropriately fixedly secured by one or several bolts 42 at the housing 10. The platform shaft 38 which is normally prestressed in the downward direction by spring 43 engaging, on the one hand, at the supporting wall portion 39 and, on the other, against a spring abutment 44 fixed on the shaft 38, accommodates in its lower end a cam follower member 45 in the form of a ball which follows the cam surface 51 (FIGS. 2 and 6) of a cam member generally designated by reference numeral 50, which is fixedly secured, for example, by screws 52 to a fourth sprocket wheel 53 mounted by conventional means for rotation with a central cam shaft 54. A chain 55 thereby establishes a driving connection between the second sprocket gear 35 and the fourth sprocket gear 53. The number of teeth in the sprocket gears 34, 37, 35 and 53 is thereby such that, for example, the platform shaft 38 rotates four times while the central cam shaft 54 rotates once. As can be seen from FIG. 2, the central cam shaft 54 is also drivingly supported between the base plate 11 and the intermediate supporting wall 39.

A timing cam 57 is also fixedly connected with the central cam shaft 54 at the lower end thereof. The timing cam 57 cooperates with a microswitch 58 of commercial type to close a holding circuit once the timing cam has begun to rotate, as will be described more fully hereinafter in connection with the operation of the present invention.

The platform shaft 38 is fixedly connected with a recessed platform 47 which receives within a recess 47' thereof a container-receiving member 48 of appropriate configuration. It can be readily seen that different sizes of containers can be readily accommodated by the electric capping machine of the present invention by merely interchanging the container-receiving member 48.

Additionally, in order to provide smooth operation, adjustable plier brakes of conventional type and generally designated by reference numerals 60 and 65, respectively, (FIG. 3) may be provided for the shafts 54 and 30, respectively. The adjustable plier brake 60 may abut with its free legs, for example, against the shaft 30 as abutment, since the shaft 54 rotates in the clockwise direction as viewed in FIG. 3, and may be adjusted by means of a simple screw and nut arrangement 61. Similarly, a simple screw and nut arrangement 66 may be used to adjust the braking action of the adjustable plier brake 65 whose free ends are mounted over and supported by a stud 67 fixedly mounted in the housing 10 (FIGS. 2 and 3). Of course, the free legs of the adjustable plier brake 60 may also be supported by a fixedly mounted stud as in the case of the plier brake 65.

The crimping mechanism of the capping machine of the present invention which can be seen from FIGS. 1 and 2 includes a housing ferrule generally designated by reference numeral 70 which includes an externally threaded portion 71 and an adjoining tapering portion 72 forming a camming surface. The housing ferrule 70 is threadably received within a threaded bore 73 provided in the reinforced elongated top center housing portion 16. An abutment roller 75 is suitably connected with a spring-loaded shaft 76 which is slidably received within the housing ferrule 70 and slidingly extends through the downwardly tapering ends of the housing ferrule 76. The shaft 76 and therewith the roller 75 are normally urged in the downward direction by a spring 77 engaging at the upper end against an upper fixed spring abutment 78 and at the lower end against a spring washer or plate 79 fixed on the shaft 76. A ball bearing 80 may thereby be interposed between shaft 76 and abutment roller 75 provided to enable relative rotation between the shaft 76 and the pressure roller 75. The crimping mechanism of the capping machine of the present invention is adjustable by up and down movement of the shaft 76 to provide for proper crimping of the edge of the cap. For that purpose, the upper end of the shaft 76 is provided with a transverse slot 76' for engagement with a tool, such as a screw driver. A crimping roller generally designated by reference numeral 85 (FIGS. 1 and 2) and made, for example, of nylon or equivalent material includes bevelled crimping surfaces 86 (FIG. 2) adapted to engage with the cap 109 of container 110 (FIG. 1) during the crimping action. The crimping roller 85 is rotatably supported on a shaft portion 87 of a crimping head holder generally designated by reference numeral 88 (FIGS. 2 and 5) whereby the shaft portion 87 projects from a flat base portion 89 which is adjoined on both sides thereof by perpendicularly extending side walls 90 and 91 which are somewhat longer than the base portion 89 and which are each provided at the two ends thereof with outwardly projecting pivot pins 92, 93, 94 and 95. Two three-hole link members 95 and 96 are thereby pivotally connected with the pins 92 and 94 while two two-hole links 97 and 98 are thereby pivotally connected with the pins 93 and 95, respectively. Each of the links 92–95 is threadably secured by means of appropriate screws 108 with a crimping head base generally designated by reference numeral 100 (FIGS. 1, 2 and 4) to provide thereby a quadrilateral linkage connection between the crimping head base 100, on the one hand, and the crimping head holder 88 as well as the crimping roller 85, on the other. As can be seen in particular from FIG. 4, the crimping head base 100 is provided with a notched or recessed portion 101 of rectangular shape (FIG. 4) which engages with a fixed bracket member generally designated by reference numeral 105 (FIGS. 1 and 2) which is provided with a guide portion 106 of a shape complementary to the rectangular notch 101 so that the crimping head base 100 is constrained into up and down movement along the bracket member 105, 106. The upper ends of the links 95 and 96 support therebetween a roller member 99 forming a cam follower which is operable to follow the tapered camming surface 72 of the housing ferrule 70 to provide the automatic inward movement of the crimping roller 85 toward the edge of the cap 109 as the cap of the container comes into engagement with the abutment roller 75 while being elevated by the platform shaft 38. To ensure continuous engagement between the cam follower roller member 99 and the tapering surface 72, a two-legged torsion spring 102 is provided which engages with angularly bent-off ends thereof, respectively, in corresponding holes provided in the crimping head base 100 and in the crimping head holder 88, as indicated somewhat schematically in FIG. 2. The crimping head base 100 is thereby fastened to the shaft 76, for example, by a set screw 103 (FIG. 1) which is adapted to engage in the threaded bore 104 of the crimping head base 100, as shown in FIG. 4. Hence, any upward movement of the abutment roller 75 together with shaft 76 will result in an identical upward movement of the crimping head base 100, thereby causing the roller member 99 to run up along the tapering surface 72 and thereby causing the link member 95 to pivot in the clockwise direction, as viewed in FIG. 2, whereby as a result of the quadrilateral linkage, the crimping roller 85 is caused to undergo a positively controlled movement inwardly toward the edge of the cap.

Figure 7:
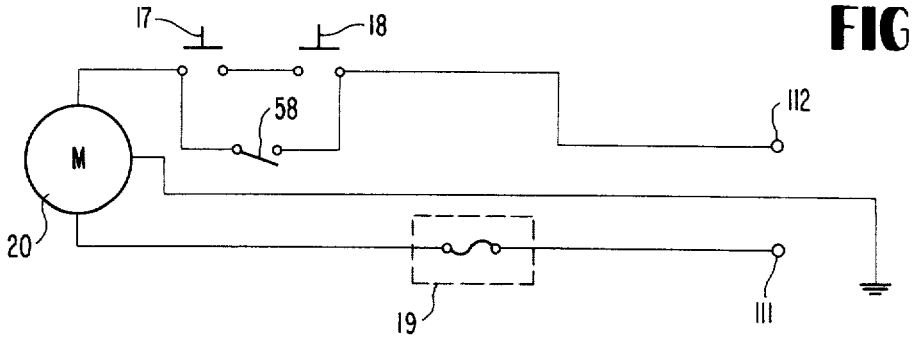
FIG. 7 is a schematic wiring diagram of the electric capping machine in accordance with the present invention.

The electric motor 20 which is adapted to be energized from an electric voltage supply of, for example 110–120 volts by way of lines 111 and 112, is normally disconnected from the electric power supply by the normally open switches of push buttons 17 and 18 and by the normally open microswitch 58. However, the motor 20 can be energized by simultaneously depressing the two push buttons 17 and 18 (FIG. 7) whereby the motor 20 is set into rotation and will cause rotation of the center shaft 54 by way of the chain and sprocket connection 35, 55, 52, so that the microswitch 58 will now be closed by the timing cam 57, thereby providing a holding circuit until one revolution of the timing shaft 54 is completed, at which time the microswitch 58 will again be permitted to open, whence the motor 20 will be de-energized. Hence, to start the cycle of operation, it is only necessary to temporarily depress both push buttons 17 and 18 for such length of time until the timing cam 57 establishes this holding circuit. From then on, the cycle of operation of the capping machine is fully automatic until one cycle is completed.

IN OPERATION

After the operator has placed a container 110 with a cap 109 thereon in proper position on the container-receiving member 48, the operator will depress with both hands the two push buttons 17 and 18 and will thereby start the cycle of automatic operation as explained hereinabove. The series-connection of the two push buttons 17 and 18 is thereby a significant safety feature as the operation of the capping machine cannot be started until both hands are out of the way of the crimping mechanism, i.e., are used to depress the two push buttons 17 and 18.

Once the motor 20 is energized, the automatic cycle of operation will commence as soon as the microswitch 58 is closed by the timing cam 57. Rotation of the shaft 30 will cause spinning of the platform shaft 38 which simultaneously begins to be elevated as a result of rotation of the cam 50 which will cause the cam follower 45 to follow the rising portion 51' (FIG. 2) thereby causing the cap 109 to engage the abutment roller 75. The various parts are so adjusted that the upward stroke of the platform shaft 38 will also cause the abutment roller 75, the shaft 76 and therewith the crimping head base 100 to move upwardly a predetermined distance so that the roller 99 follows the tapering surface 72 in this upward motion and thereby causes the crimping roller 88 to be brought into engagement with the edge of the cap 109 of the container 110. At the same time, the platform shaft 38 will continue to rotate due to its splined connection with the sprocket gear 37 which continues to be driven from the shaft 30 by way of the sprocket gear 34 and the chain 36 so that the crimping roller 85 now engages the cap 109 during its several rotations, thereby reliably crimping the entire periphery of the cap. During this operation, the cam follower 45 will remain on the raised surface portion 51'' of the cam 50. The cam 50 is thereby so constructed that the platform shaft 38 will again be lowered as the cam shaft 54 nears completion of one revolution and the timing cam 57 is about to open the microswitch 58. The number of revolutions which the platform 48 will perform during one revolution of the cam shaft 54 can be selected at will by appropriate gear ratios. For example, as mentioned hereinabove, the number of gear teeth may be so selected that the platform shaft 38 will carry out four revolutions during one revolution of the cam shaft 54. As the platform shaft 38 and therewith the platform 47 and container-receiving member 48 and therewith the container 110 itself are again lowered, the spring 77 will cause the parts 75, 76 and 100 to be also lowered again, thereby pivoting the link member 95 in the counterclockwise direction as viewed in FIG. 2 since the roller member 99 now slides down along the tapering surface 72, whence the crimping roller 85 is now pivoted out of engagement with the edge of the cap 109. The cycle is completed when the timing cam 57 opens the microswitch 58, at which time the parts are again in the position as shown in FIG. 2. The operator will then remove the container with the crimped cap thereon and will place another container with an uncrimped cap thereon into the container-receiving member 48 and will then start another cycle of operation by depressing simultaneously again the two push button switches 17 and 18.

The timing cam 57 may thereby be so constructed in relation to the microswitch 58 and the cam surfaces 51, 51' and 51'' that the operator must depress both push buttons 17 and 18 for a certain length of time, for example, until the platform shaft 38 has achieved substantially its full elevation at which time the cap 109 will be in engagement with the abutment roller 75 and will therefore minimize the danger of injury to any fingers that might be caught between the top of the cap 109 and the bottom of the abutment roller 75.

It can be readily seen from the foregoing that the electric capping machine of the present invention is relatively simple in construction and utilizes relatively few parts of simple, sturdy construction, yet all parts are positively guided to increase the reliability of operation. Additionally, all parts can be made of relatively simple, yet sturdy construction readily adapted to series production, thereby ensuring low costs and a long life of service of the machine. Additionally, by adjusting the shaft 76 and/or by interchanging the container-receiving member 48 and/or the abutment roller 75, it is possible to use the machine of the present invention with a large number of containers, vials or bottles of different sizes and types.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A capping machine for crimping the caps of containers, which is operable to carry out automatically one complete cycle of operation, once initiated by an operator, comprising housing means, container-receiving platform means, drive means including first means for rotating said platform means and second means for controllably raising and lowering said platform means in timed relation to the operating cycle, and a crimping mechanism above the platform means and operable to engage the cap of a container on the platform means when being raised and rotated by said drive means, including crimping roller means and mechanical means for positively controlling the movement of said crimping roller means toward and away from the edge of the cap in dependence on the raising and lowering movements of the container and cap on the platform means.

2. A machine according to claim 1, further comprising control means for controlling the operation of said drive means in such a manner that the machine carries out only one complete cycle of operation upon initiation of the operating cycle by an operator.

3. A machine according to claim 2, wherein said drive means includes an electric motor with an energizing circuit, and said control means includes several switch means series-connected in the energizing circuit of the motor to require simultaneous closing thereof before the motor can be energized.

4. A machine according to claim 3, wherein said control means includes holding circuit means in parallel with the switch means and operable to be closed for one cycle of operation by the second means, once the motor is energized by simultaneously closing the several switch means.

5. A machine according to claim 4, characterized in that two series-connected switch means are provided which are disposed on opposite sides of the housing means.

6. A machine according to claim 5, characterized in that the switch means are push buttons located in the lower portion of the housing means on opposite sides thereof.

7. A machine according to claim 5, wherein the drive means includes drive shaft means, a platform shaft means operable to be raised and lowered and operatively connected with said platform means, further shaft means, cam means operatively connected with said further shaft means for rotation with said further shaft means and provided with cam surface means, a cam follower operatively connected with said platform shaft means and operable to engage said cam surface means, and means drivingly connecting said drive shaft means with said platform shaft means and with said further shaft means.

8. A machine according to claim 7, wherein during one complete operating cycle, the cam shaft means will perform several revolutions for each revolution of the further shaft means.

9. A machine according to claim 8, wherein said cam means further includes a timing cam means operatively connected with said further shaft means for rotation in unison therewith, said timing cam means being operatively associated with a normally open switch and operable to close said normally open switch during one complete operating cycle upon manual initiation of the operating cycle.

10. A machine according to claim 9, wherein said one switch is connected in parallel with said two series-connected switch means.

11. A machine according to claim 8, further comprising adjustable plier brakes for at least some of said shaft means.

12. A machine according to claim 10, wherein said housing means includes a lower housing portion, enclosing on all sides thereof the drive means and control means, and two relatively narrow, upwardly extending L-shaped bracket housing parts disposed substantially centrally of the lower housing portion, said L-shaped bracket housing parts, together with a reinforced top housing part of greater length forming a substantially U-shaped upper housing portion.

13. A machine according to claim 12, wherein the motor is disposed on one side of the upper housing portion while the crimping mechanism is disposed toward the opposite side thereof.

14. A machine according to claim 13, wherein the crimping mechanism is supported at least in part in said reinforced top housing part near the end thereof on the opposite side.

15. A machine according to claim 13, wherein the crimping mechanism includes a cylindrical housing member threadably secured in the top center housing part of the housing means and provided with a downwardly tapering camming surface means, an abutment member mounted on a shaft within said housing member and axially displaceable with respect thereto, a crimping head base means fixedly connected with said shaft, and linkage means operatively connecting said crimping roller means with said crimping head base means and including a cam follower member operable to engage the tapering camming surface means of said housing member during axial movement of the abutment member.

16. A machine according to claim 15, wherein said linkage means includes two linkage members on each side of said crimping head base means, said linkage members being pivotally connected with said crimping head base means and with said crimping roller means.

17. A machine according to claim 16, wherein one of said linkage members on each side is extended and carries the cam follower member.

18. A machine according to claim 17, wherein said crimping roller means includes a crimping head holding member and a crimping wheel pivotally mounted thereon.

19. A machine according to claim 18, further comprising adjustable plier brakes for at least some of said shaft means.

20. A machine according to claim 1, wherein the drive means includes drive shaft means, a platform shaft means operable to be raised and lowered and operatively connected with said platform means, further shaft means, cam means operatively connected with said further shaft means for rotation with said further shaft means and provided with cam surface means, a cam follower operatively connected with said platform shaft means and operable to engage said cam surface means, and means drivingly connecting said drive shaft means with said platform shaft means and with said further shaft means.

21. A machine according to claim 20, wherein during one complete operating cycle, the cam shaft means will perform several revolutions for each revolution of the further shaft means.

22. A machine according to claim 20, wherein said cam means further includes a timing cam means operatively connected with said further shaft means for rotation in unison therewith, said timing cam means being operatively associated with a normally open switch and operable to close said normally open switch during one complete operating cycle upon manual initiation of the operating cycle.

23. A machine according to claim 22, wherein said drive means includes an electric motor with an energizing circuit, and said control means includes several switch means series-connected in the energizing circuit of the motor to require simultaneous closing thereof before the motor can be energized.

24. A machine according to claim 23, wherein said one switch is connected in parallel with said series-connected switch means.

25. A machine according to claim 20, further comprising adjustable plier brakes for at least some of said shaft means.

26. A machine according to claim 1, wherein said housing means includes a lower housing portion, enclosing on all sides thereof the drive means, and two relatively narrow, upwardly extending L-shaped bracket housing parts disposed substantially centrally of the lower housing portion, said L-shaped bracket housing parts, together with a reinforced top housing part of greater length forming a substantially U-shaped upper housing portion.

27. A machine according to claim 12, wherein an electric motor forming part of the drive means is disposed on one side of the upper housing portion while the crimping mechanism is disposed toward the opposite side thereof.

28. A machine according to claim 27, wherein the crimping mechanism is supported at least in part in said reinforced top housing part near the end thereof on the opposite side.

29. A machine according to claim 1, wherein the crimping mechanism includes a cylindrical housing member threadably secured in the top of the housing means and provided with a downwardly tapering camming surface means, an abutment member mounted on a shaft within said housing member and axially displaceable with respect thereto, a crimping head base means fixedly connected with said shaft, and linkage means operatively connecting said crimping roller means with said crimping head base means and including a cam follower member operable to engage the tapering camming surface means of said housing member during axial movement of the abutment member.

30. A machine according to claim 29, wherein said linkage means includes two linkage members on each side of said crimping head base means, said linkage members being pivotally connected with said crimping head base means and with said crimping roller means.

31. A machine according to claim 30, wherein one of said linkage members on each side is extended and carries the cam follower member.

32. A machine according to claim 30, wherein said crimping roller means includes a crimping head holding member and a crimping wheel pivotally mounted thereon.

33. A machine according to claim 1, wherein said first means for rotating said platform means includes means for rotating said platform means which are spaced from and operatively independent from said crimping mechanism.

34. A machine according to claim 1, wherein said mechanical means for positively controlling the movement of said crimping roller means includes means responsive exclusively to forces transmitted from said cap of a container to force said crimping roller means in a direction toward the edge of the cap.

35. A machine according to claim 33, wherein said mechanical means for positively controlling the movement of said crimping roller means includes means responsive exclusively to forces transmitted from said cap of a container to force said crimping roller means in a direction toward the edge of the cap.

36. A capping machine for crimping the caps of containers comprising housing means, container-receiving platform means, drive means including first means for rotating said platform means and second means for controllably raising and lowering said platform means, and a crimping mechanism above the platform means and operable to engage the cap of a container on the platform means when being raised and rotated by said drive means, wherein the drive means includes drive shaft means, a platform shaft means operable to be raised and lowered and operatively connected with said platform means, further shaft means, cam means operatively connected with said further shaft means for rotation with said further shaft means and provided with cam surface means, a cam follower operatively connected with said platform shaft means and operable to engage said cam surface means, and means drivingly connecting said drive shaft means with said platform shaft means and with said further shaft means.

37. A capping machine for crimping the caps of containers comprising housing means, container-receiving platform means, drive means including first means for rotating said platform means and second means for controllably raising and lowering said platform means, and a crimping mechanism above the platform means and operable to engage the cap of a container on the platform means when being raised and rotated by said drive means, wherein the crimping mechanism includes a downwardly tapering camming surface means, an abutment member mounted on the shaft within said housing member and axially displaced with respect thereto, a crimping head base means fixedly connected with said shaft, a crimping roller means engageable with said caps, and linkage means operatively connecting said crimping roller means with said crimping head base means and including a cam follower member operable to engage the tapering camming surface means of said housing member during axial movement of the abutment member, wherein said linkage means includes two linkage members on each side of said crimping head base means, said linkage members being pivotally connected with said crimping head base means and with said crimping roller means.

38. A machine according to claim 37, wherein one of said linkage members on each side is extended and carries the cam follower member.

* * * * *